US006354559B1

(12) United States Patent
Eisentraut

(10) Patent No.: US 6,354,559 B1
(45) Date of Patent: Mar. 12, 2002

(54) INSTRUMENT SUSPENSION SYSTEM FOR PRESERVING ALIGNMENT

(75) Inventor: Rudolph A. Eisentraut, Tucson, AZ (US)

(73) Assignee: Hughes Missile Systems Company, Los Angeles, CA (US)

( * ) Notice: Subject to any disclaimer, the term of this patent is extended or adjusted under 35 U.S.C. 154(b) by 0 days.

(21) Appl. No.: 08/506,060

(22) Filed: Jul. 24, 1995

(51) Int. Cl.[7] ..... F41G 7/26
(52) U.S. Cl. ..... 248/638; 244/3.16
(58) Field of Search ..... 248/638, 581, 248/637, 676, 678, 631; 244/3.16

(56) References Cited

U.S. PATENT DOCUMENTS 4,619,421 A * 10/1986 Trummer ..... 244/3.16

* cited by examiner

*Primary Examiner*—Ramon O. Ramirez
*Assistant Examiner*—Long Dinh Phan
(74) *Attorney, Agent, or Firm*—Charles D. Brown; Wanda K. Denson-Low

(57) ABSTRACT

A passive suspension system for supporting an instrument relative to a rigid support structure while preserving angular alignment of the instrument. The suspension system includes an instrument platform, the instrument being secured to the platform, and first and second vibration isolator systems. The first ends of the isolator systems are attached to the rigid support structure so that axes of the vibration isolators extend transverse to the instrument axis. The first and second isolator systems resist motion transverse to the instrument axis and provide shock and vibration isolation transverse to the instrument axis. First, second and third stabilizing struts extend parallel to each other and the instrument axis, and are of equal length. A first set of bearings connects ends of the struts to the instrument platform in a spaced relationship, and allows motion transverse to the struts. A second set of bearings connects opposing ends of the struts to the rigid support structure in a spaced relationship. The second set of bearings permits motion transverse to the struts.

24 Claims, 3 Drawing Sheets

FIG. 3
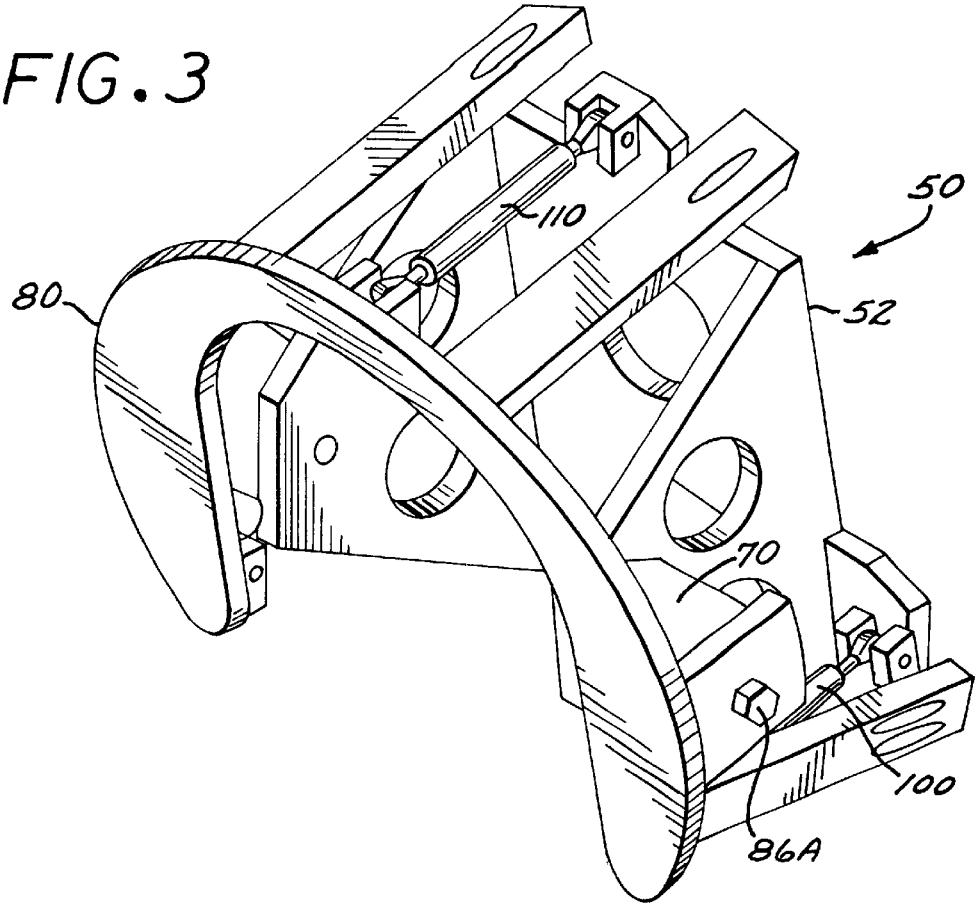
FIG. 4
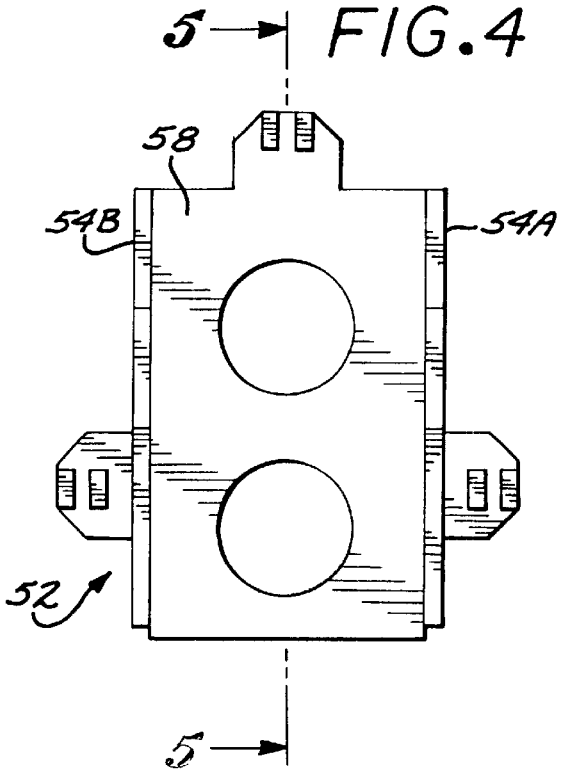
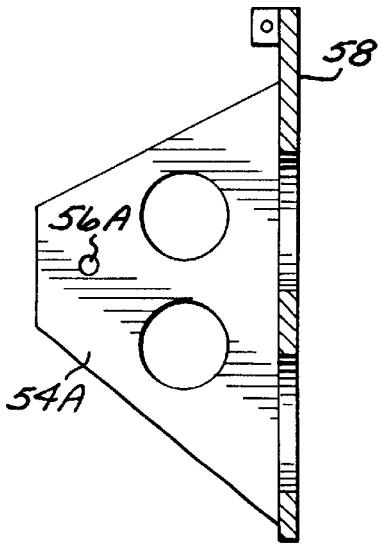
FIG. 5

FIG. 6
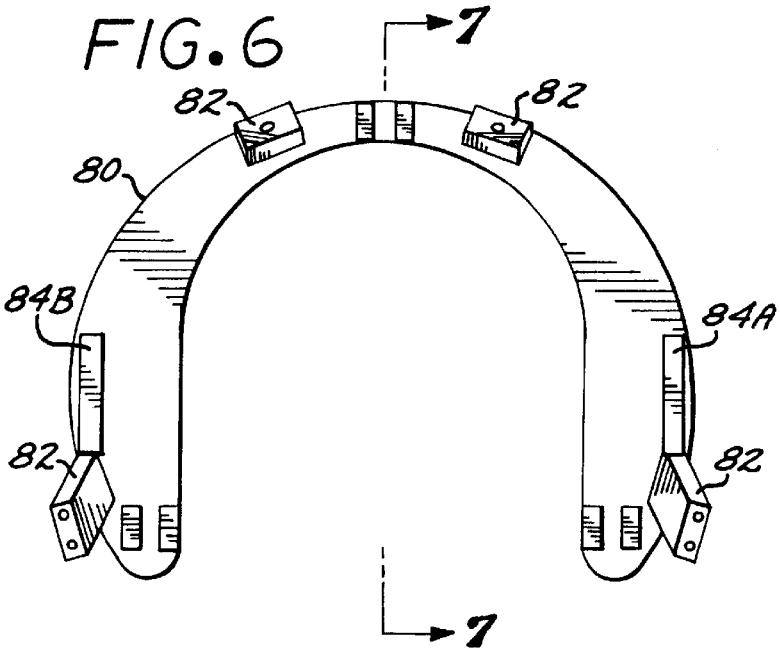
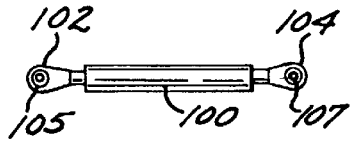
FIG. 8
FIG. 7
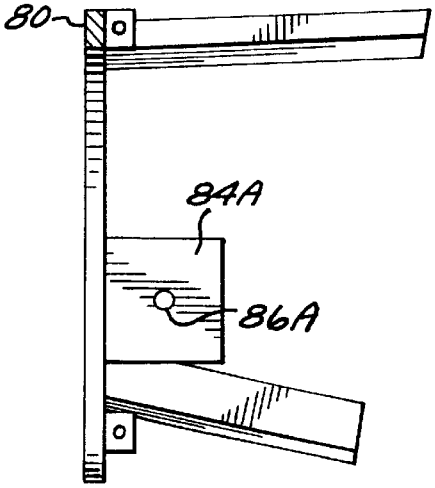
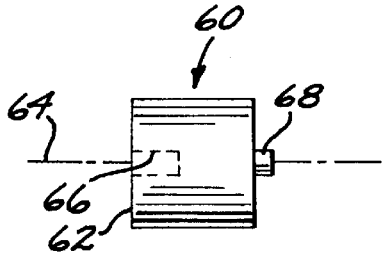
FIG. 9A
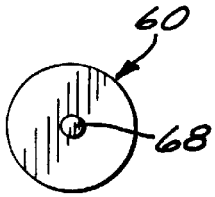
FIG. 9B

INSTRUMENT SUSPENSION SYSTEM FOR PRESERVING ALIGNMENT

TECHNICAL FIELD OF THE INVENTION

This invention relates to suspension systems for suspending instruments such as a missile seeker while preserving the instrument alignment.

BACKGROUND OF THE INVENTION

Conventional missile seeker suspension systems require two separate systems; one for shock and vibration isolation, and the other a mechanism to align the instrument when alignment is required. Typically, these suspension systems have required an active system, with powered actuators and sensors with closed loop control.

The invention provides both functions with one passive system that remains in alignment resulting in substantial cost savings and increased reliability.

SUMMARY OF THE INVENTION

A passive suspension system is described for supporting an instrument relative to a rigid support structure while preserving angular alignment of the instrument. The system is particularly useful for supporting a seeker instrument in a nose of a missile, for example. The suspension system includes an instrument platform, the instrument being secured to the platform, and first and second isolator systems. Each isolator system includes a first end and a second end. The first isolator system defines a first axis, and the second isolator system defines a second axis, with the first and second axes colinearly arranged to define an elastic center of the isolators. The center of gravity of the suspended mass, including the mass of the instrument platform and the instrument, lies on the elastic center. The first ends of the isolator systems are attached to the rigid support structure; the second ends of the isolator systems are attached to the instrument platform. The first and second isolator systems comprise means for resisting motion of the platform and for providing shock and vibration isolation.

The suspension system further includes first, second and third stabilizing struts extending parallel to each other and of equal length. Each strut includes a first strut end and a second strut end. A first set of bearings connects the strut first ends to the instrument platform in a spaced relationship. The first set of bearings allows only motion transverse to the strut axis. A second set of bearings connects the strut second ends to the rigid support structure in a spaced relationship. The second set of bearings permits only motion transverse to the strut axis.

BRIEF DESCRIPTION OF THE DRAWING

These and other features and advantages of the present invention will become more apparent from the following detailed description of an exemplary embodiment thereof, as illustrated in the accompanying drawings, in which:

FIG. 3 is an isometric view of the suspension system.

FIG. 4 is a top view of the instrument platform comprising the suspension system as illustrated in FIG. 3.

FIG. 5 is a side cross-sectional view of the instrument platform, taken along line 5—5 of FIG. 4.

FIG. 6 is a bottom view of the horseshoe-shaped structure comprising the suspension system as illustrated in FIG. 3.

FIG. 7 is a side cross-sectional view of the horseshoe-shaped structure, taken along line 7—7 of FIG. 6.

FIG. 8 is a side view of an exemplary one of the suspension system stabilizing struts.

FIG. 9A is a side view of one of the suspension system isolators;

FIG. 9B is an end view of the isolator.

DETAILED DESCRIPTION OF THE PREFERRED EMBODIMENT

A simple passive suspension system is described for supporting an instrument relative to a rigid support structure while preserving angular alignment of the instrument. The preferred embodiment described herein is adapted for a missile application, wherein a seeker instrument or other instrument guidance instrument is the instrument supported by the suspension system relative to a rigid support structure secured to the missile front ring. The invention is not limited to missiles and seeker instruments, and will have utility in supporting sensitive instruments in an environment in which angular alignment is important in the presence of vibration and shock.

Figure 1:
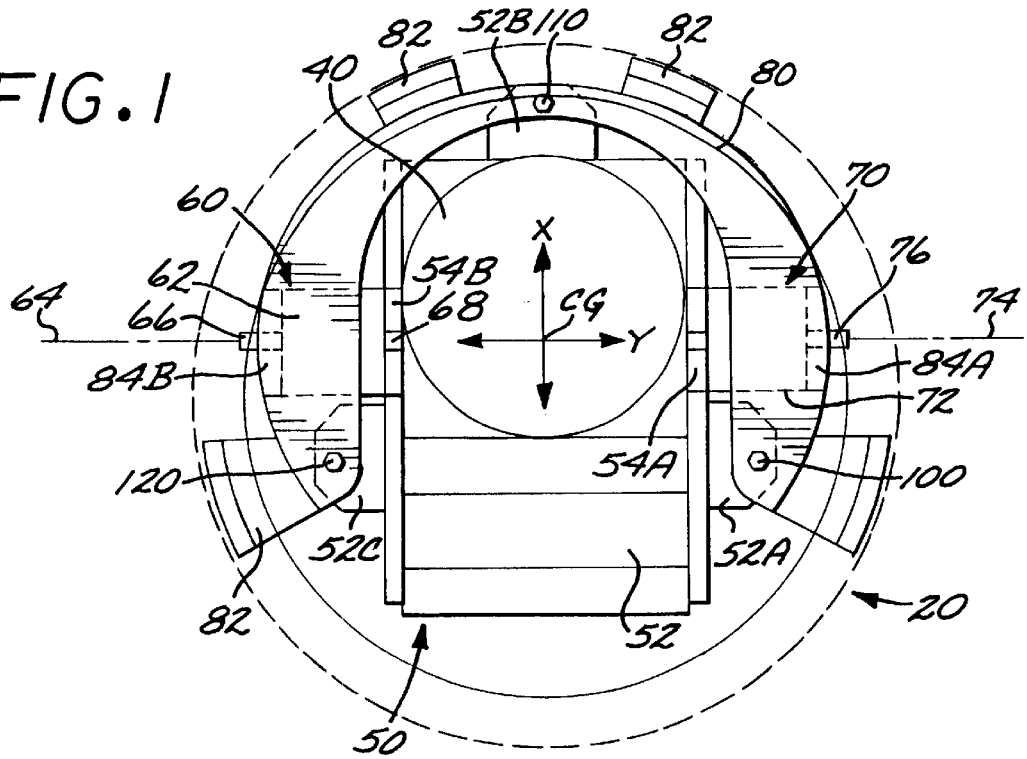
FIG. 1 is an end view of a missile including a seeker instrument mounted in the nose of the missile by a suspension system in accordance with the invention.
Figure 2:
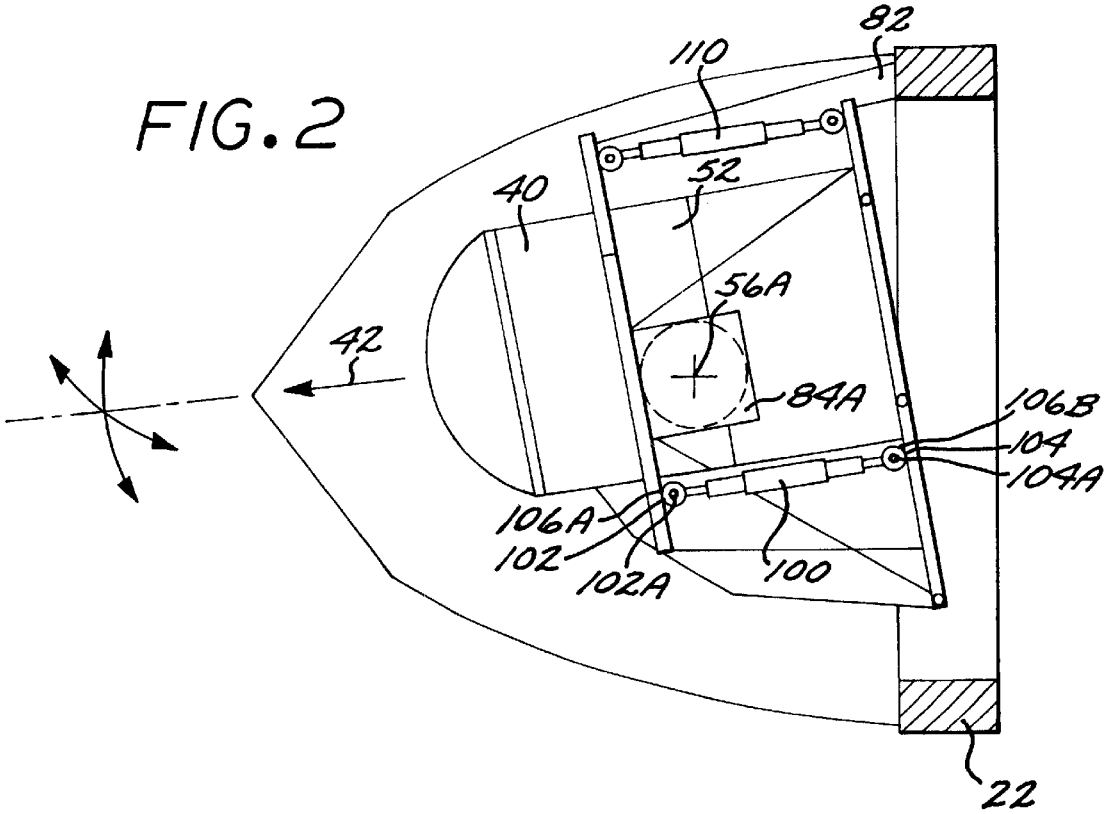
FIG. 2 is a side view of the nose area of the missile of FIG. 1 showing the suspension system in further detail.

FIG. 1 is an end view of a missile 20 including a seeker instrument 40 mounted in the nose of the missile by a suspension system 50 in accordance with the invention. FIG. 2 is a side view of the nose area of the missile 20, showing the suspension system 50 in further detail. The seeker 40 has a seeker line of sight (LOS) 42. It is desired to isolate the seeker from vibration while supporting the seeker within the nose of the missile 20.

The seeker 40 is attached to an instrument platform 52 comprising the suspension system 50. The platform 52 defines an adaptor structure which cradles the seeker unit 40.

FIG. 3 is an isometric view of the suspension system 50, without the seeker 40 secured to the instrument platform 52. FIGS. 4 and 5 are views of the instrument platform 52 in isolation.

The suspension system 50 further includes two opposed isolators 60 and 70. FIGS. 9A and 9B illustrate an exemplary one (60) of the isolators in isolation. Each isolator is a cylindrical member fabricated of an elastomeric material such as rubber, with a threaded rod extending from one end of the cylinder, and a threaded receptacle opening formed in the other end. Thus, isolator 60 includes a cylindrical rubber member 62 defining a first isolator axis 64, threaded bolt 68 extending from one end of the cylindrical member 62, and threaded receptacle opening 66 formed in the other end. The bolt and receptacle are on the axis 64. In a similar fashion, isolator 70 includes a cylindrical rubber member 72 defining a second isolator axis 74, and threaded bolt 78 extending from one end of the cylindrical member 72 and threaded receptacle opening 76 formed in the opposed end.

The instrument platform 52 includes first and second opposed side plates 54A and 54B extending transversely to a planar support plate 58. The side plates provide a means for attaching one end of each of the isolators to the platform structure 52. The side plates include openings, including opening 56A formed in plate 54A, to receive therethrough threaded fastener bolts, to be threaded into the respective threaded receptacle openings 66 and 76 of the isolator cylinders.

The opposed, outer threaded rod ends of the isolators 60 and 70 are secured to a horseshoe-shaped structure 80 standing on four legs 82 attached to the missile front ring 22. The structure 80 and legs 82 are shown in isolation in FIGS. 6 and 7. Mounting lugs 84A and 84B extend from the structure 80 to receive in mounting openings (e.g., opening 86A in lug 84A) formed therein to receive therethrough the threaded ends of rods 66 and 76. Threaded fasteners (e.g., fastener 86A, FIG. 3) can be employed to secure the ends of the rods to the mounting lugs.

It will be seen from FIGS. 1 and 2 that the isolator axes 64 and 74 are collinear and intersect the center of gravity (CG) of the suspended mass supported by the suspension system 50. The suspended mass includes the mass of the instrument 40, the mass of the instrument platform 52, and a portion of the mass of the isolators 60 and 70. The isolator axes define an isolator elastic center, which coincides with the CG. The elastic center is the location of a hypothetical effective single spring which would achieve the same effect as the isolators 60 and 70. When the two isolators are identical, the elastic center is centered between the two isolators. Preferably, the CG is centered between the two isolators 60 and 70.

The stiffness of isolators 60 and 70 is greater in compression than in shear. Preferably the isolators are identical and matched in stiffness, collinear and symmetrical to provide an isoelastic system having an elastic center. Other arrangements of the isolators can be used, so long as the isolator system is isoelastic. The CG of the suspended mass should lie on an axis which intersects the elastic center, and in this embodiment this axis is preferably parallel to the instrument LOS.

The seeker 40 is stabilized by three equal length struts 100, 110 and 120 extending parallel to each other. In this exemplary embodiment, the struts also extend parallel to the seeker LOS 42. FIG. 8 shows an exemplary one of the struts (100) in isolation. The forward ends (relative to the missile nose) of the struts are supported by the horseshoe-shaped structure 80, and the rear ends of the struts are attached to the instrument platform 52.

The struts include rod end bearings which do not permit motion in directions aligned with the strut body or axis, but do permit motion transverse to the strut axis. In this embodiment, the bearings allow motion normal to the LOS 42. Thus, for example, as shown in FIGS. 2 and 8, strut 100 includes at opposed ends thereof rod end bearings 102 and 104 which comprise spherical openings formed in the strut ends and ball elements 105 and 107 which are fitted into the spherical openings. Bearing bores 102A and 104A are formed in the ball elements. Rods, including exemplary rods 106A and 106B, extend through the bores and through corresponding bores formed in strut mounting lugs 52A, 52B and 52C for the instrument platform 52 and in strut mounting lugs extending from the horseshoe-shaped structure 80. It will be seen that this bearing arrangement is in the nature of a ball joint which permits rotational movement of the strut about the ball element 105 or 107, but which does not permit motion along the longitudinal axis of the strut. The isolators 60 and 70 resist this motion and provide shock and vibration isolation normal to the struts and normal to the LOS.

While the preferred embodiment employs struts 100, 110 and 120 which are parallel to the instrument LOS, in many applications this condition may not be necessary. With the CG of the suspended mass located on the elastic center of the isolators, any vertical displacement (x or pitch direction) or lateral displacement (y or yaw direction) will not produce a rotation of the instrument about the roll axis or LOS. On the other hand, if the struts are not aligned with the LOS, then a rotation of the instrument about an axis parallel to the struts will cause a misalignment of the LOS.

While the disclosed embodiment has oriented the isolators 60 and 70 to be transverse to the instrument LOS, in order to provide isolation to shock and vibration transverse to the LOS, other applications may have the isolator axes in other directions. For example, the isolators could be arranged to be parallel to the instrument axis, to provide isolation to shock and vibration force components which are equal in the x and y directions.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. A passive suspension system for supporting an instrument relative to a rigid support structure, the system comprising:

a support structure;

an instrument platform, the instrument being secured to said platform;

first and second vibration isolators, each said isolator comprising a first end and a second end, said first isolator defining a first isolator axis, said second isolator defining a second isolator axis, wherein said first and second isolator axes are collinear and form an isolator elastic center, said first ends attached to said support structure, said second ends attached to said instrument platform, said first and second isolators comprising means for resisting motion and for providing shock and vibration isolation;

first, second and third stabilizing struts extending parallel to each other and of equal length, each of said struts having a first strut end and a second strut end;

first means for coupling said first strut ends to said support structure;

second means for coupling said second strut ends to said instrument platform;

wherein the instrument platform and instrument are suspended from said support structure and comprise a suspended mass, and wherein the suspended mass is characterized by a center of gravity (CG) which coincides with the elastic center.

2. The suspension system of claim 1 wherein said first coupling means comprises a first set of bearings for connecting said strut first ends to said support structure in a spaced relationship, said first set of bearings allowing motion transverse to longitudinal axes of said struts, but not allowing motion along said longitudinal axes.

3. The suspension system of claim 1 wherein said second coupling means comprises a second set of bearings for connecting said strut second ends to said instrument platform in a spaced relationship, said second set of bearings permitting motion transverse to longitudinal axes of said struts, said first and second isolators resisting said transverse motion, said second set of bearings not allowing motion along said longitudinal axes.

4. The suspension system of claim 1 wherein longitudinal axes of said struts are arranged in parallel with an axis of said instrument.

5. The suspension system of claim 1 wherein said elastic center lies on an axis of said instrument.

6. A passive suspension system for supporting an instrument relative to a rigid support structure, the system comprising:

a support structure;

an instrument platform, the instrument being secured to said platform and characterized by an instrument axis;

first and second vibration isolators, each said isolator comprising a first end and a second end, said first ends attached to said support structure, said second ends attached to said instrument platform, said first and second isolators forming an isoelastic system having an elastic center and comprising means for resisting motion and for providing shock and vibration isolation;

first, second and third stabilizing struts extending parallel to each other, each of said struts having a first strut end and a second strut end and having a length dimension between said first and second ends which is equal to a corresponding length dimension of the other struts;

first means for coupling said first strut ends to said support structure;

second means for coupling said second strut ends to said instrument platform;

wherein the instrument platform and instrument are suspended from said support structure and comprise a suspended mass, and wherein the suspended mass is characterized by a center of gravity (CG) which lies on an axis which intersects said elastic center.

7. The suspension system of claim 6 wherein said first coupling means comprises a first set of bearings for connecting said strut first ends to said support structure in a spaced relationship, said first set of bearings allowing motion transverse to longitudinal axes of said struts, but not allowing motion along said longitudinal axes.

8. The suspension system of claim 6 wherein said second coupling means comprises a second set of bearings for connecting said strut second ends to said instrument platform in a spaced relationship, said second set of bearings permitting motion transverse to longitudinal axes of said struts, said first and second isolators resisting said transverse motion said second set of bearings not allowing motion along said longitudinal axes.

9. The suspension system of claim 6 wherein said struts are characterized by longitudinal axes arranged in parallel with said instrument axis.

10. A passive suspension system for supporting an instrument relative to a rigid support structure while preserving angular alignment of the instrument, the system comprising:

a support structure;

an instrument platform, the instrument being secured to said platform and characterized by an instrument axis;

first and second vibration isolators, each said isolator comprising a first end and a second end, said first isolator defining a first isolator axis, said second isolator defining a second isolator axis, wherein said first and second isolator axes are collinear and form an isolator elastic center, said first ends attached to said support structure, said second ends attached to said instrument platform so that said first and second axes extend transverse to said instrument axis, said first and second isolators comprising means for resisting motion transverse to said instrument axis and for providing shock and vibration isolation transverse to said instrument axis;

first, second and third stabilizing struts extending parallel to each other, each of said struts having a first strut end and a second strut end;

first means for coupling said first strut ends to said support structure;

second means for coupling said second strut ends to said instrument platform;

wherein the instrument platform and instrument are suspended from said support structure and comprise a suspended mass, and wherein the suspended mass is characterized by a center of gravity (CG) which coincides with the elastic center;

said first and second isolators resisting motion of said instrument platform transverse to said instrument axis.

11. The suspension system of claim 10 wherein said first coupling means comprises a first set of bearings for connecting said strut first ends to said support structure in a spaced relationship, said first set of bearings allowing motion transverse to longitudinal axes of said struts, but not allowing motion parallel to said longitudinal axes.

12. The suspension system of claim 10 wherein said second coupling means comprises a second set of bearings for connecting said strut second ends to said instrument platform in a spaced relationship, said second set of bearings permitting motion transverse to longitudinal axes of said struts, said first and second isolators resisting said transverse motion, said second set of bearings not allowing motion parallel to said longitudinal axes.

13. The suspension system of claim 10 wherein longitudinal axes of said struts are arranged in parallel with said instrument axis.

14. A passive suspension system for supporting an instrument relative to a rigid support structure while preserving angular alignment of the instrument, the system comprising:

a support structure;

an instrument platform, the instrument being secured to said platform and characterized by an instrument axis;

first and second vibration isolators, each said isolator comprising a first end and a second end, said first isolator defining a first isolator axis, said second isolator defining a second isolator axis, said first ends attached to said support structure, said second ends attached to said instrument platform so that said first and second axis extend transverse to said instrument axis, said first and second isolator comprising means for resisting motion transverse to said instrument axis and for providing shock and vibration isolation transverse to said instrument axis;

first, second and third stabilizing struts extending parallel to each other, each of said struts having a first strut end and a second strut end;

first means for coupling said first strut ends to said support structure;

second means for coupling said second strut ends to said instrument platform;

said first and second isolators resisting motion of said instrument platform transverse to said instrument axis.

15. The suspension system of claim 14 wherein said first and second isolator axes are collinear to define an elastic center, and wherein said instrument platform and said instrument are suspended from said support structure and comprises a suspended mass having a center of gravity (CG), and wherein said elastic center coincides with said CG.

16. The suspension system of claim 14 wherein said first coupling means comprises a first set of bearings for connecting said strut first ends to said support structure in a spaced relationship, said first set of bearings allowing motion transverse to said instrument axis, but not allowing motion parallel to said instrument axis.

17. The suspension system of claim 14 wherein said second coupling means comprises a second set of bearings for connecting said strut second ends to said instrument platform in a spaced relationship, said second set of bearings permitting motion transverse to said instrument line of sight, said first and second isolators resisting said transverse motion, said second set of bearings not allowing motion parallel to said instrument axis.

18. A passive suspension system for supporting an instrument relative to a rigid support structure while preserving angular alignment of the instrument, the system comprising:

a rigid support structure;

an instrument platform, the instrument being secured to said platform and characterized by an instrument axis;

first and second vibration isolators, each said isolator comprising a first end and a second end, said first isolator defining a first isolator axis, said second isolator defining a second isolator axis, said first ends attached to said rigid support structure, said second ends attached to said instrument platform so that said first and second axis extend transverse to said instrument axis, said first and second isolator comprising means for resisting motion transverse to said instrument axis and for providing shock and vibration isolation transverse to said instrument axis;

first, second and third stabilizing struts extending parallel to each other, each of said struts having a first strut end and a second strut end;

a first set of bearings for connecting said strut first ends to said instrument platform in a spaced relationship, said first set of bearings allowing motion transverse to said instrument axis but not allowing notion parallel to said instrument axis; and a second set of bearings for connecting said strut second ends to said rigid support structure in a spaced relationship, said second set of bearings permitting motion transverse to said struts, said first and second isolators resisting said transverse motion, said second set of bearings not permitting motion parallel to said instrument axis.

19. The suspension system of claim 18 wherein said first and second isolator axes are collinear and define an elastic center, and wherein said instrument platform and said instrument are suspended from said support structure and comprise a suspended mass, said suspended mass characterized by a center of gravity (CG) coinciding with said elastic center and equidistant from said first and second isolators.

20. The suspension system of claim 18 wherein said rigid support structure includes a horseshoe shaped structure defining an open region, said instrument and said instrument platform being disposed within said open region.

21. A missile, comprising:

a missile body including a nose and missile front ring;

a missile guidance instrument having an instrument axis;

a support structure rigidly attached to said missile front ring;

an instrument platform, the instrument being secured to said platform and characterized by an instrument axis;

first and second vibration isolators, each said isolator comprising a first end and a second end, said first isolator defining a first isolator axis, said second isolator defining a second isolator axis, said first ends attached to said rigid support structure, said second ends attached to said instrument platform so that said first and second axis extend transverse to said instrument axis, said first and second isolators comprising means for resisting motion transverse to said instrument axis and for providing shock and vibration isolation transverse to said instrument axis;

first, second and third stabilizing struts extending parallel to each other, each of said struts having a first strut end and a second strut end;

a first set of bearings for connecting said strut first ends to said instrument platform in a spaced relationship, said first set of bearings allowing motion transverse to said struts, but not allowing motion parallel to longitudinal axes of said struts; and a second set of bearings for connecting said strut second ends to said rigid support structure in a spaced relationship, said second set of bearings permitting motion transverse to said struts only, said first and second isolators resisting said transverse motion, said second set of bearings not permitting motion parallel to longitudinal axes of said struts.

22. The missile of claim 21 wherein said first and second isolator axes are collinear and define an elastic center, and wherein said instrument platform and said instrument are suspended from said support structure and comprise a suspended mass, said suspended mass characterized by a center of gravity (CG) which coincides with said elastic center.

23. The missile of claim 21 wherein said rigid support structure includes a horseshoe shaped structure defining an open region, said instrument and said instrument platform being disposed within said open region.

24. The missile of claim 21 wherein said struts are arranged in parallel with said longitudinal axes of said instrument axis.

* * * * *